US007989735B1

(12) United States Patent
Richmond et al.

(10) Patent No.: US 7,989,735 B1
(45) Date of Patent: Aug. 2, 2011

(54) HEATING APPARATUS FOR HEAT RETAINING HAIR CLIPS

(75) Inventors: David Richmond, Culver City, CA (US); Howard Richmond, Culver City, CA (US); Henry K. Yu, El Segundo, CA (US); Matthew W. Tivnon, El Segundo, CA (US); Craig R. Steele, El Segundo, CA (US)

(73) Assignee: Linda Flowers, Los Angeles, CA (US)

( * ) Notice: Subject to any disclaimer, the term of this patent is extended or adjusted under 35 U.S.C. 154(b) by 0 days.

(21) Appl. No.: 12/950,978

(22) Filed: Nov. 19, 2010

(51) Int. Cl.

| | |
|---|---|
| ***H05B 3/22*** | (2006.01) |
| ***H05B 3/26*** | (2006.01) |
| ***A45D 2/36*** | (2006.01) |
| ***A45D 4/16*** | (2006.01) |
| ***A45D 4/18*** | (2006.01) |

(52) U.S. Cl. ..... 219/222; 219/225; 219/521; 219/530; 219/537; 219/540; 132/231; 132/234; 132/277

(58) Field of Classification Search ..... None
See application file for complete search history.

(56) References Cited

U.S. PATENT DOCUMENTS

| | | | | | |
|---|---|---|---|---|---|
| 2,127,784 | A | * | 8/1938 | Rosch | 132/234 |
| 2,133,573 | A | * | 10/1938 | Rifle | 126/229 |
| 2,143,740 | A | * | 1/1939 | McIntosh | 132/211 |
| 2,161,202 | A | * | 6/1939 | Schleimer | 219/242 |
| 2,491,939 | A | | 12/1949 | Tasho | |
| 3,045,097 | A | * | 7/1962 | Sellers | 219/539 |
| 3,858,029 | A | * | 12/1974 | Walter | 219/222 |
| 3,887,790 | A | * | 6/1975 | Ferguson | 219/535 |
| 3,889,097 | A | * | 6/1975 | Forsberg | 219/242 |
| 4,661,683 | A | * | 4/1987 | Glucksman | 219/222 |
| 4,766,291 | A | * | 8/1988 | Collins | 219/534 |
| 5,294,777 | A | | 3/1994 | Denhup | |
| 5,522,407 | A | | 6/1996 | Kelsey | |
| D388,903 | S | * | 1/1998 | Kelsey | D28/38 |
| 5,873,377 | A | | 2/1999 | Yang | |
| 6,248,979 | B1 | * | 6/2001 | Cafaro | 219/222 |
| 7,631,649 | B2 | | 12/2009 | Coral et al. | |
| 2005/0087205 | A1 | | 4/2005 | Rizzuto | |
| 2008/0236606 | A1 | | 10/2008 | Flowers | |

* cited by examiner

*Primary Examiner* — Joseph M Pelham

(74) *Attorney, Agent, or Firm* — Laura M. Lloyd; Jeffrey G. Sheldon; Sheldon Mak & Anderson

(57) ABSTRACT

Apparatus for heating hair clips having a heatable member comprises a base, a heating structure, and means for providing electricity to the heating structure. The heating structure can comprise an elongated electrical heater having opposed sides, a plurality of thermally conductive heating elements in pairs on each side of the electrical heater, and a thermal insulator between the heating elements separating the heating elements from each other.

22 Claims, 5 Drawing Sheets

HEATING APPARATUS FOR HEAT RETAINING HAIR CLIPS

BACKGROUND

Many different devices for hair styling have been developed. These include commercially available heated devices such as curling irons, flat irons, and hair rollers. The hair rollers currently available are round and contain an opening in the center of the roller to allow for their placement on a uniformly heated rod. Typically, a plurality of heated upwardly extending rods are arranged on a non-heated base, and the hair rollers are placed over the heated rods. Each heating rod is capable of heating only one hair roller at a time.

A system comprising heatable hair clips and a device for heating the hair clips is described in Flowers, U.S. Patent Publication Serial Number 2008/0236606, incorporated herein by reference. Although the Flowers device is effective for styling hair and heating the clips, it is desirable to have a device that is more efficient and safer for the consumer.

SUMMARY

An apparatus for heating hair clips having a heatable member according to the present invention satisfies the need for an improved heating device. An apparatus having features of the present invention comprises a base, a heating structure for heating the heatable members of the clips, and means for providing electricity for powering the heating structure. The heating structure can comprise a heater supported by the base, and a plurality of thermally conductive heating elements in thermally conductive relationship with the heater for heating the heatable members. The heat elements are formed of a thermally conductive material and they are separated from each other by an insulating material that remains substantially non-heated when the heating elements are heated by the heater. Preferably the heater is an elongated heating bar. Preferably the base is a tray having a longitudinal axis where the heaters likewise are elongated and are supported by opposed end walls of the tray. Typically there are two substantially parallel heating structures, where the heating elements are positioned on the side walls of the heater in pairs, so there is one heating element for each heatable member of hair clips.

Preferably there is a silicone ring around each heating element for insulation.

Optionally, the apparatus can be provided with a soft openable case for the tray. The case has an open configuration wherein each heating structure is accessible and a closed configuration wherein each heating structure is not accessible.

The heating elements are configured to match the structure of the hair clip heatable members, and where the heatable members are double concave, the heating elements are double convex.

Preferably there is a temperature controller for use in controlling the temperature of the heater. Also preferably there is at least one heat balancer, and typically two heat balancers, one on each side of the heater, for distributing heat from the heater to the heating elements.

The heating structure can comprise a bracket with openings for holding the heating elements in place.

A preferred heating structure comprises an elongated electrical heater having opposed sides; a plurality of thermally conductive heating elements in pairs on each side of the electrical heater for heating the heatable members of the hair clips, the heating elements being formed of a thermally conductive material; a bracket on each side of the electrical heater for supporting the heating elements and in thermally conductive contact with the electrical heater, and a thermal insulator between the heating elements separating the heating elements from each other, the thermal insulator remaining substantially non-heated when the heating elements are heated.

A method of using this apparatus comprises the step of electrically heating the heating elements; before, after or while electrically heating the heating elements, positioning hair clips having a heatable member on the heating elements; allowing the heatable members of the hair clip to heat up; removing at least some of the heated hair clips from the apparatus; and placing them on hair to be styled. After the placed hair clips have cooled, they are removed from the hair, thereby resulting in hair styling.

DRAWINGS

These and other features, aspects, and advantages of the present invention will become better understood with regard to the following description, appended claims, and accompanying drawings where:

DESCRIPTION

Figure 1:
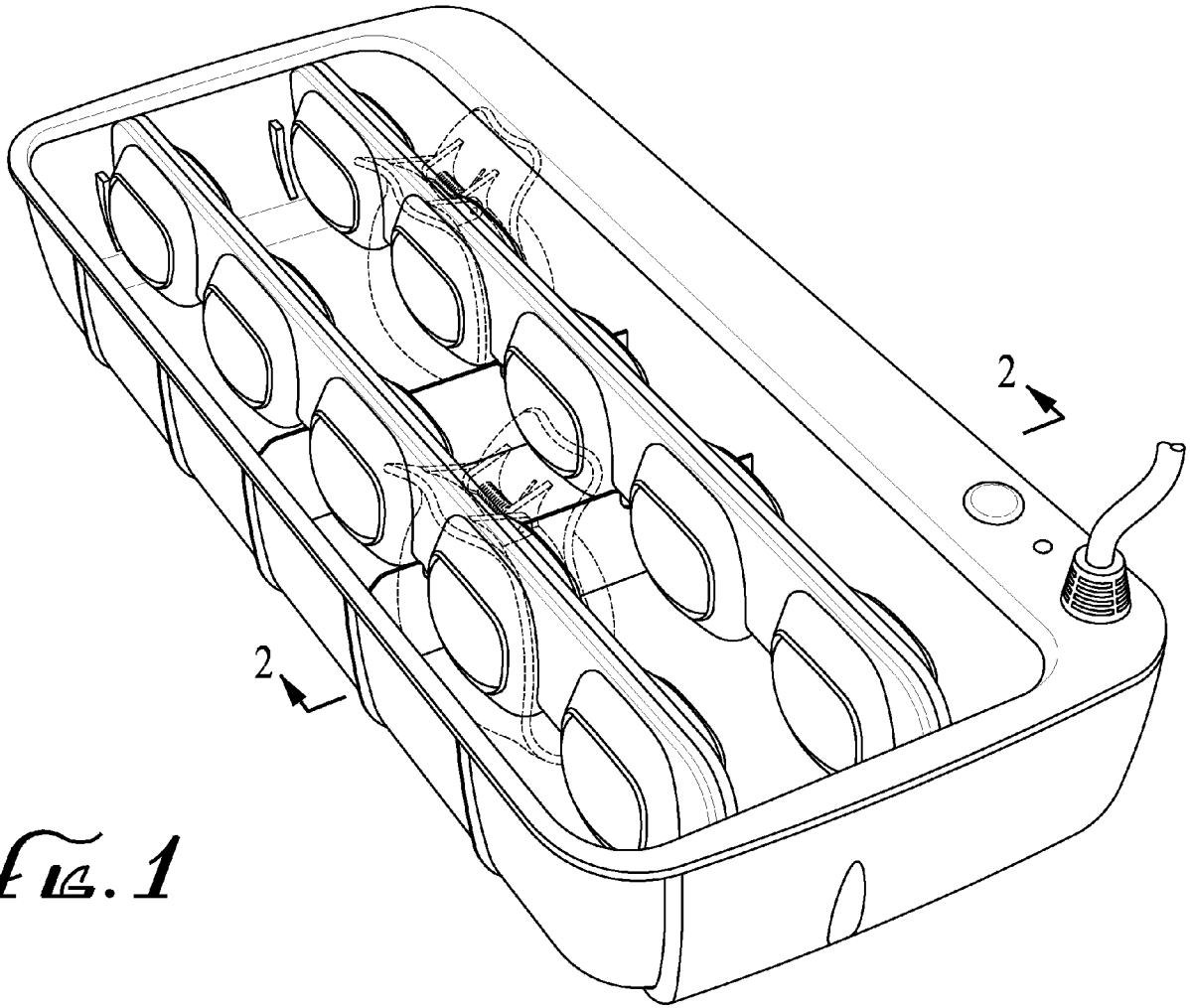
FIG. 1 is a perspective view of an apparatus having features of the present invention comprising a base and heating structures.
Figure 2:
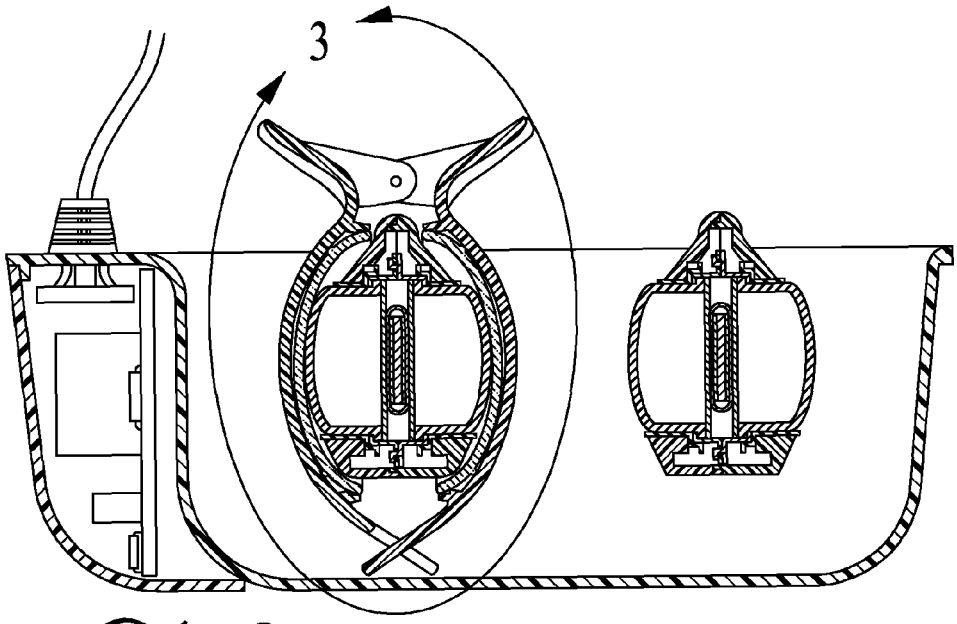
FIG. 2 is a cross-sectional side view of the apparatus of FIG. 1 taken on line 2-2 in FIG. 1 with an exemplary hair clip positioned on a heatable member.
Figure 3:
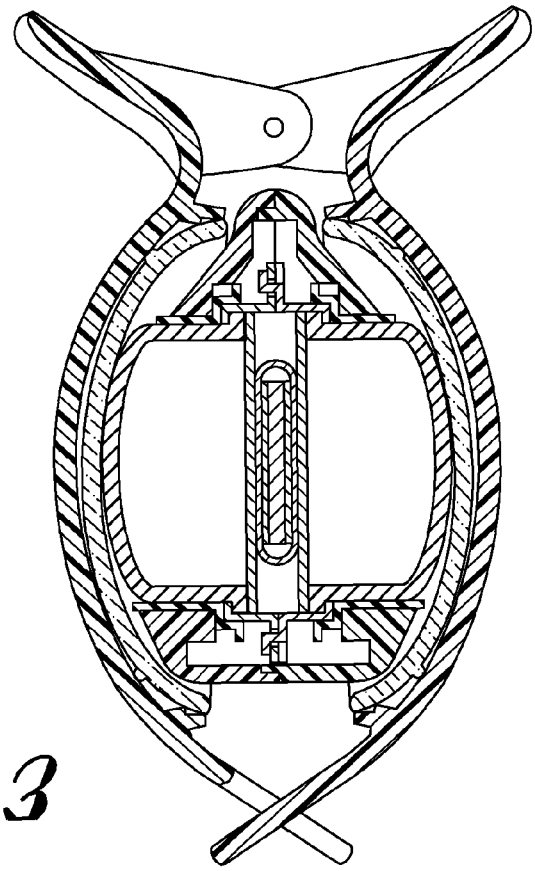
FIG. 3 shows area 3 in FIG. 2.

With regard to the figures, a version of the current invention comprises an apparatus 10 for heating heatable hair clips 11 comprising a base 12 with hair clip heating structures 13. The apparatus 10 can be provided with optional case 14 for holding the base 12.

Heatable hair clips 11 for which the invention is useful comprise a pair of hinged opposing jaws 15*a*, 15*b* biased to a closed position by, for example, a spring, with user grippable finger grip 16 portions opposite the jaws 15*a*, 15*b*. The shape of the hair clip 11 can be any shape that is able to retain hair between inner surfaces of the jaws 15*a*, 15*b* when the hair clip 11 is in a closed position. For example, the hair clip 11 can have a double concave inner surface.

The hair clip 11 contains a heatable member 17 with heat retaining means on the inner surfaces of the jaws 15*a*, 15*b*. The heatable member 17 can be made from any material that is able to retain heat, for example, ceramic material.

The base 12 is preferably an elongated tray having a longitudinal axis, an open top 18, a bottom wall 19, opposed end walls 20*a*, 20*b* and opposed side walls 21*a*, 21*b*. One or more heating structures 13 extend between and are supported by the end walls 20*a*, 20*b* of the base 12. Preferably, there are two heating structures 13, each substantially identical and having a longitudinal axis and substantially parallel to each other. Each heating structure 13 comprises an elongated electrical heater 22 that is used for heating a plurality of heating elements 23. The electrical heater 22 is made out of thermally conductive material. By "thermally conductive," it is meant that the material has a heat conductivity of at least 120 Watts per meter Kelvin (W/(m*K)).

The electrical heater 22 is powered electrically. The electrical heater 22 is electrically connected to an electrical circuit 25 that heats the electrical heater 22 to a desired between about 85 and about 105 degrees Celsius. Preferably, the electrical heater 22 is a high temperature heater for fast heat up time. The electrical heater 22 can comprise a sandwiched assembly comprising an anode, a ceramic material, and a cathode. One commercially available material that can be used for the electrical heater 22 is PTC (Shenzhen Creation Electronics, Shenzhen, PRC). The electrical heater 22 can be controlled by a temperature controller 24 such as a negative temperature coefficient (NTC) thermistor (Shenzhen Creation Electronics, Shenzhen, PRC). The NTC thermistor prevents the electrical heater 22 from heating to a dangerously high heat, and cuts off power to the electrical heater 22 before the electrical heater 22 reaches a predetermined maximum temperature such as 170 degrees Celsius.

Any means for providing electricity can be used, including anything known or developed in the future that can provide electricity to the electrical heater 22 including an electrical cord, batteries, fuel cell, or solar cell. An electrical circuit 25 is adapted to be connected to an electrical cord 26 for providing the electrical power necessary to heat the electrical heater 22. The electrical cord 26 is electrically connected to a conventional wall outlet.

The heating elements 23 are provided in pairs, one on each side of the electrical heater 22. Each heating structure 13 has a plurality of heating elements 23 in pairs, typically about five. The heating elements 23 can be used for heating hair clips 11 as described in the aforementioned Flowers Application Serial No. 2008/0236606.

The heating elements 23 have an outside surface 27 that is configured to match the heatable members 17 of the clips for intimate contact for sufficiently heating the clips. In a preferred version of the invention, the outside surface 27 of the heating elements 23 are double convex because the heatable members 17 of the clips are double concave.

The heating elements 23 are formed from a material that is easily heated and highly thermally conductive. Such material includes, but is not limited to, a metal such as aluminum, copper, heatable ceramic, brass, gold, silver and stainless steel.

The heating elements 23 are supported by brackets 28. Preferably, there are two brackets 28 for each electrical heater 22, wherein the brackets 28 are linked together so that the electrical heater 22 can slide between the two brackets 28. The brackets 28 can be linked together by any means such as hinging, crimping or by snapping together. The brackets 28 can be made of material that is thermally conductive, such as aluminum, copper, brass, and stainless steel. The brackets 28 contain a plurality of openings 29, also referred to as cut-outs, into which a heating element 23 fits. Preferably, there is one bracket opening 29 for each heating element 23 so that the heating elements 23 protrude outwardly from the brackets 28 for engagement with the hair clips 11.

Each heating structure 13 has a pair of elongated main thermal insulators 30, one for each side, to keep the regions between the heating elements 23 cool. The thermal insulators 30 are supported by the brackets 28 and have corresponding cutouts 29 through which the heating elements 23 protrude. The main thermal insulators 30 are made of material that is thermally insulating. By thermal insulating there is meant a material that has a heat conductivity of no more than 0.25 W/(m*K). The main thermal insulators 30 can be made out of material such as, for example, high temperature plastics (i.e. polyphenylene sulfide (PPS), for example, RYTON®, polysulfone (PSO), for example, UDEL®, polyestherimide (PEI), for example, ULTEM®, polyesthersulfone (PES), for example, RADEL A®, polyphenylsufone (PPSU), for example, RADEL R®, polyimide (PI), for example, MELDIN®, VESPEL®, IMIDEX®, KAPTON®, polyamide-imide (PAI), for example, TECATOR®, TORLON®) (DuPont Company, Delaware), glass, urethane, natural rubbers and silicone can be used. The thermally insulating material insulates the parts of the apparatus 10 that are not heated.

Figure 5:
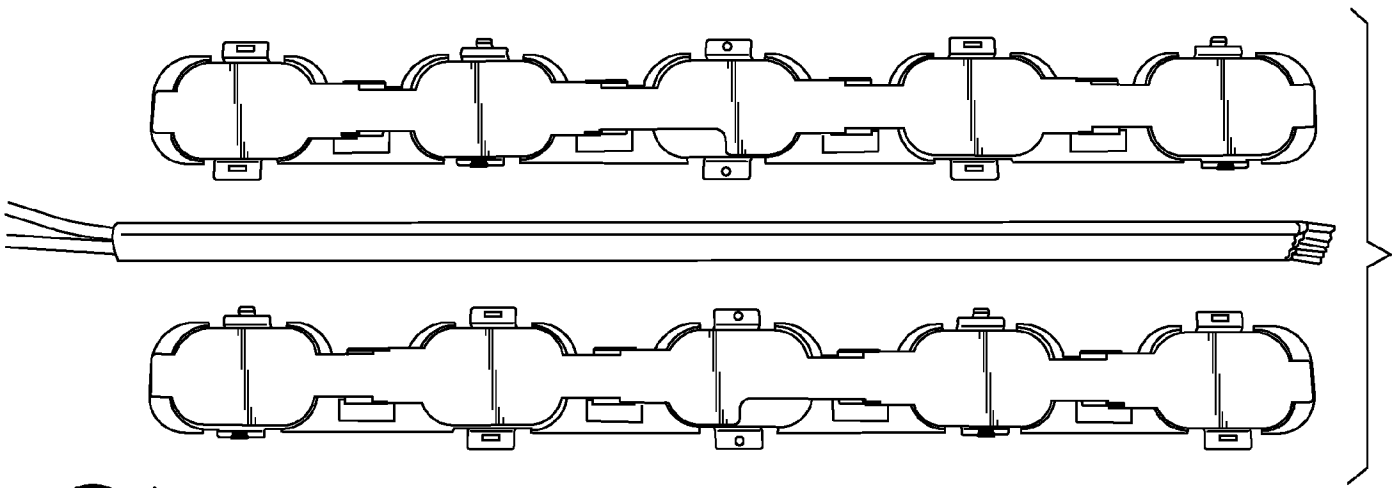
FIG. 5 is an exploded view of a heating structure of the apparatus of FIG. 1 showing the electrical heater in between two heat balancers and the balancers in between two brackets.
Figure 6:
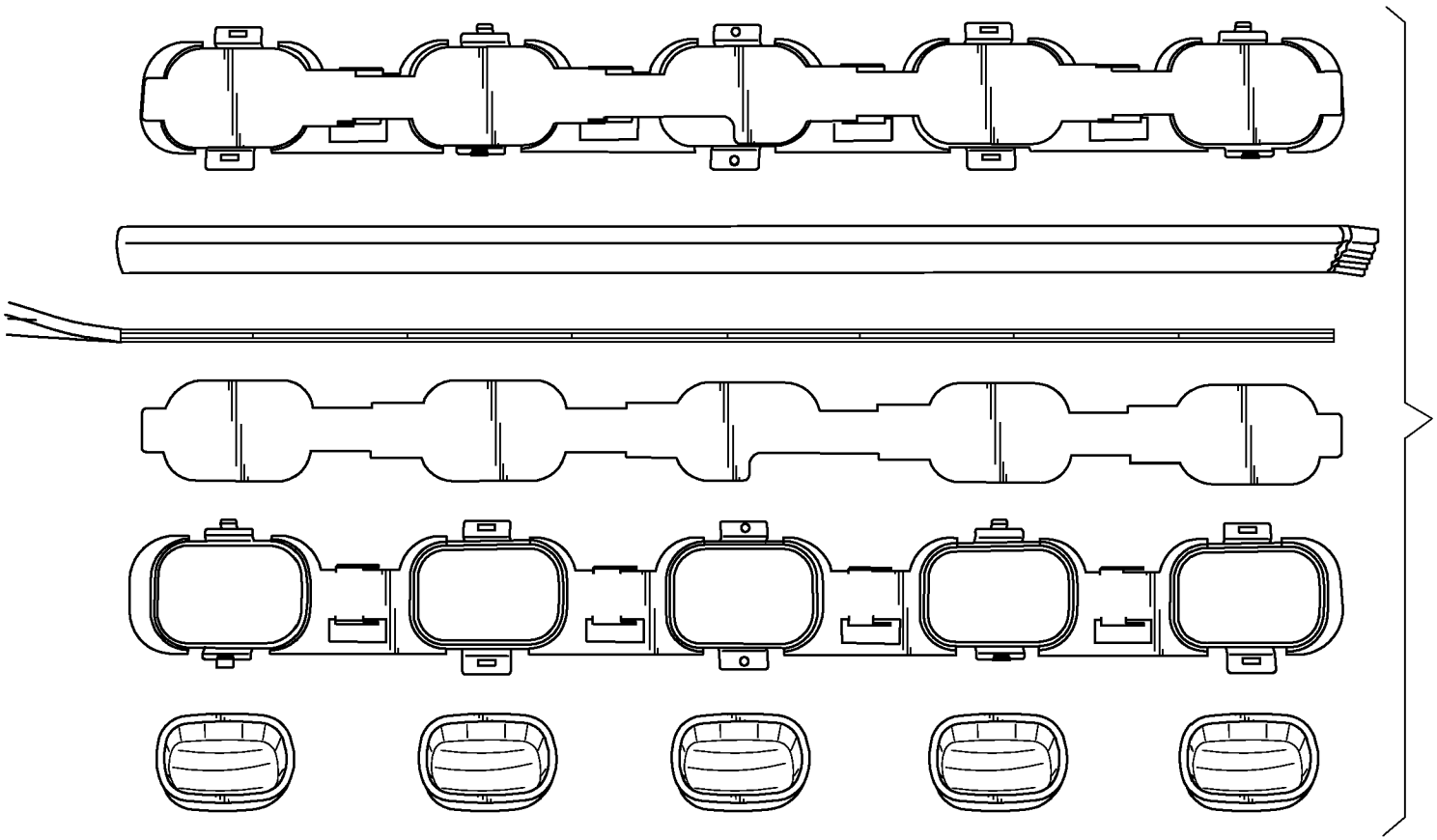
FIG. 6 is an exploded view of a heating structure of the apparatus of FIG. 1.
Figure 7:
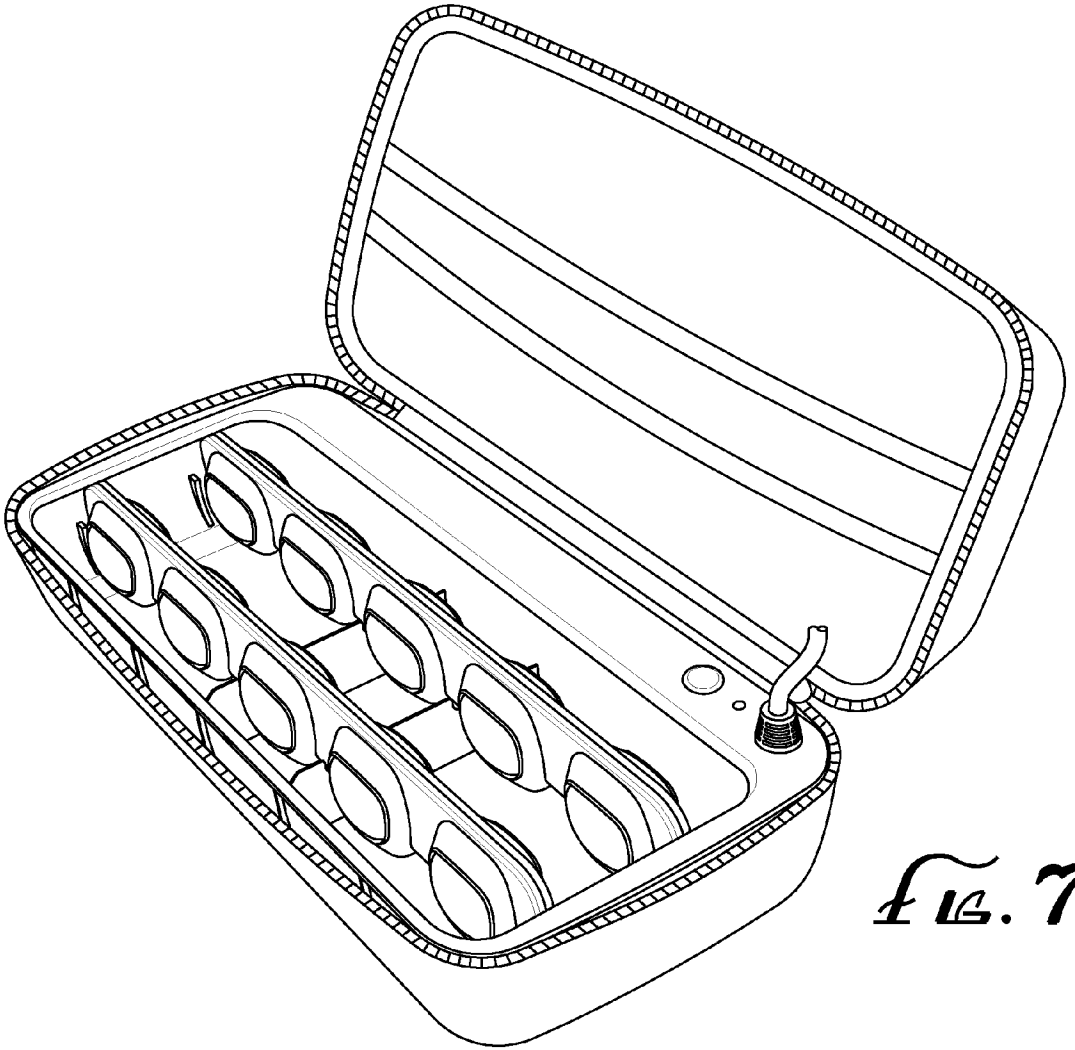
FIG. 7 is a perspective view of the apparatus of FIG. 1 located within an optional case.
Figure 1:
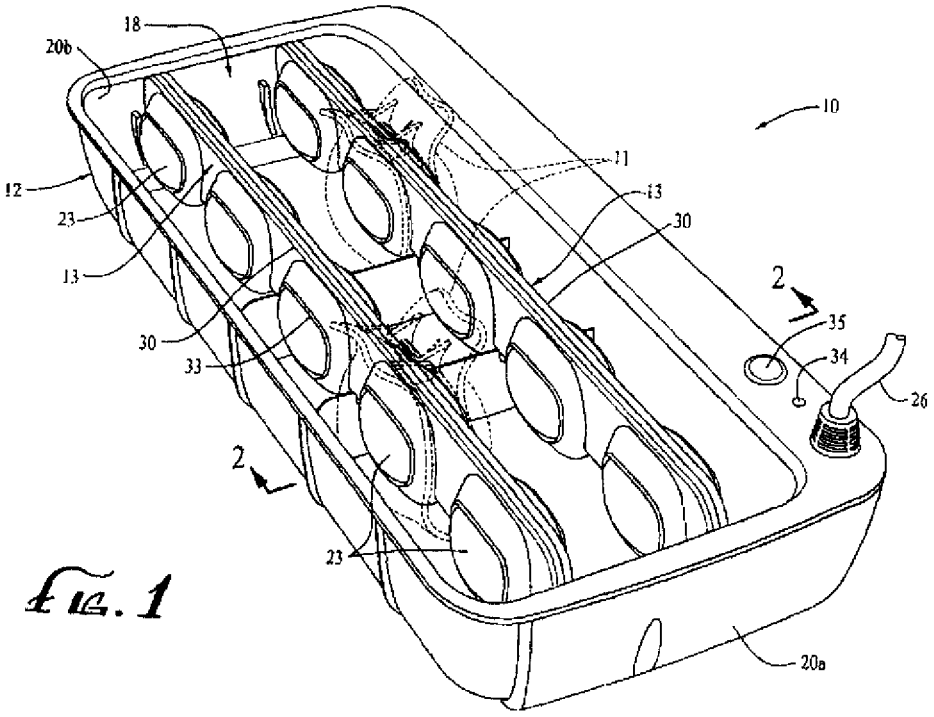
Figure 2:
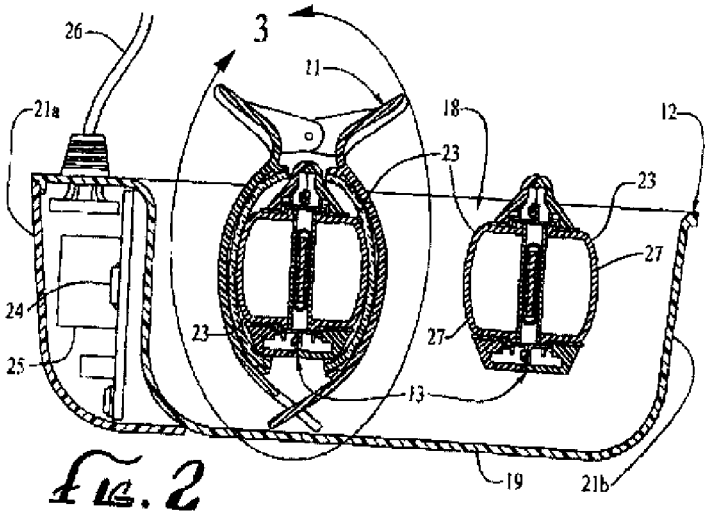
Figure 3:
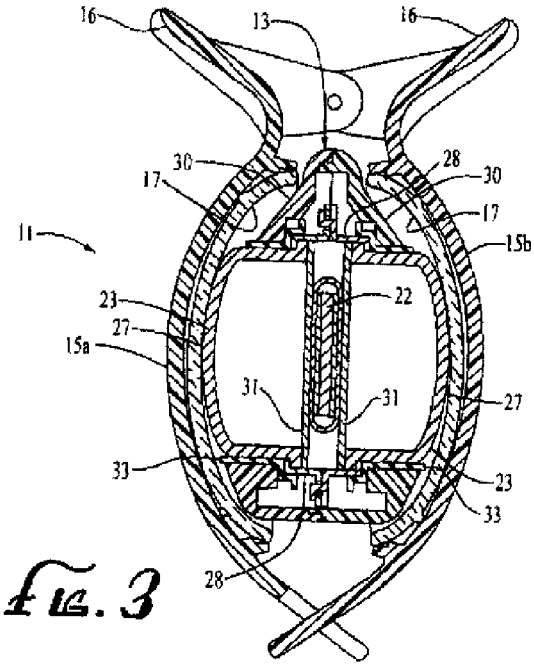
Figure 4:
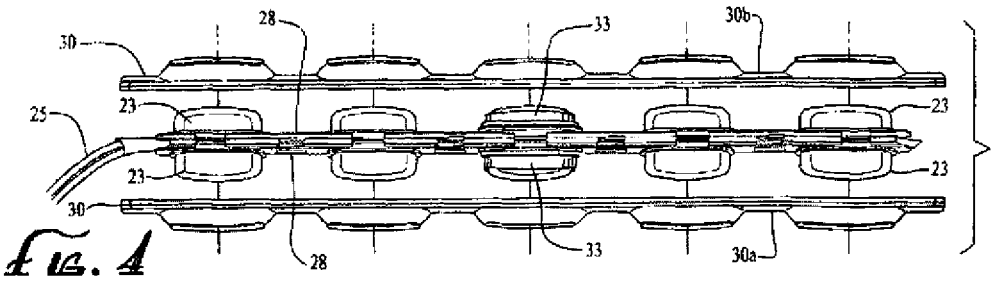
Figure 5:
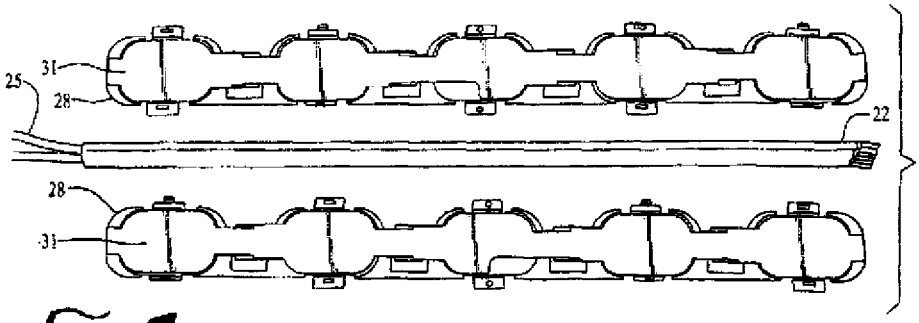
Figure 6:
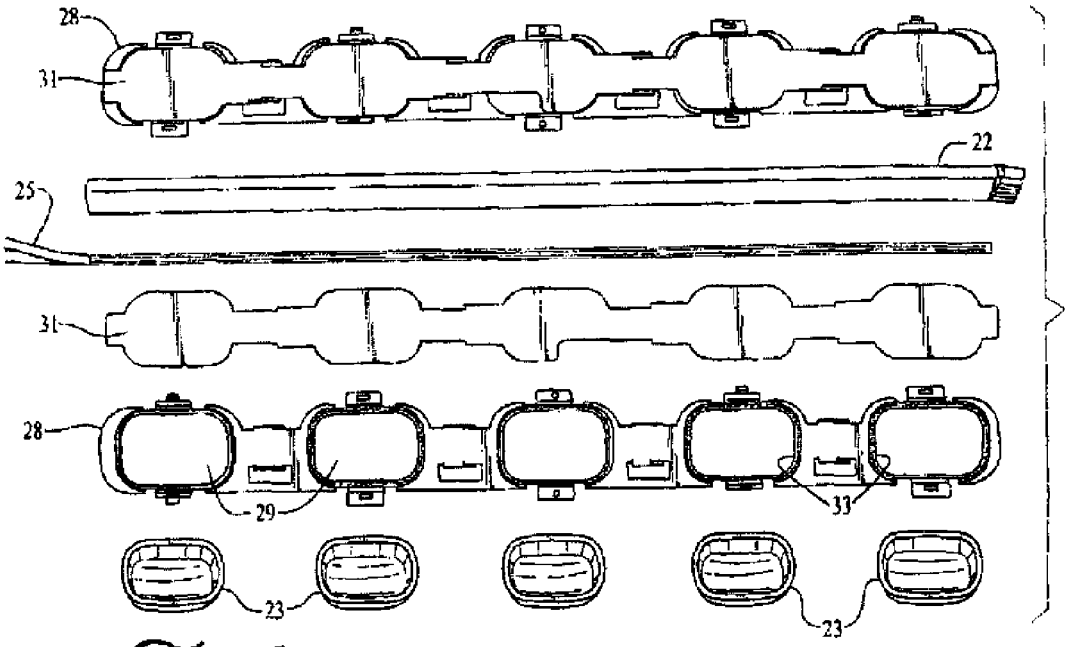
Figure 7:
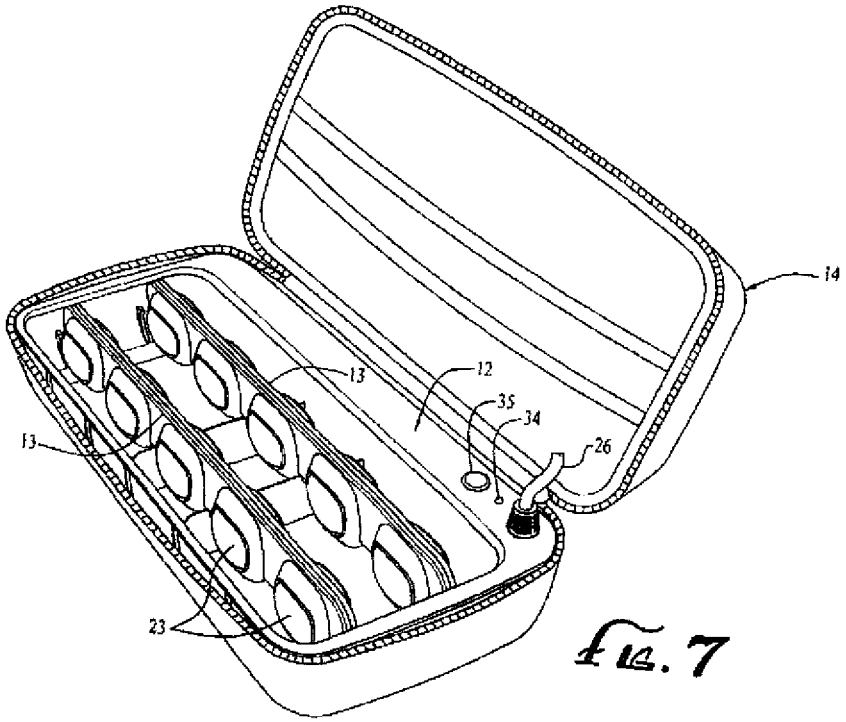

Optionally and preferably, there is a pair of heat balancers 31 for each heating structure 13, the heat balancers 31 fitting in between the electrical heater 22 and the brackets 28. FIG. 5 shows the heating structure 13 in partial disassembly, with the electrical heater 22 in between two heat balancers 31. FIG. 5 also shows that the heat balancers 31 are held by the bracket 28.

A purpose of the heat balancers 31 is to smooth out any hot spots on the heat bar, and have all of the heating elements 23 heated to about the same temperature at about the same time. The heat balancers 31 can be made of an easily heatable, thermally conductive material in order to evenly distribute the heat from the electrical heater 22 across the surface of the heat balancer 31. For example, a conductive metal plate made of aluminum, copper, heatable ceramic, brass, gold, silver or stainless steel is thermally conductive and can be used for the heat balancer 31.

On the opposing side of each heat balancer 31 is the heating element 23. The inner side of the heating element 32 contacts the heat balancer 31 along the inner perimeter edge of the heating element 23.

Figure 4:
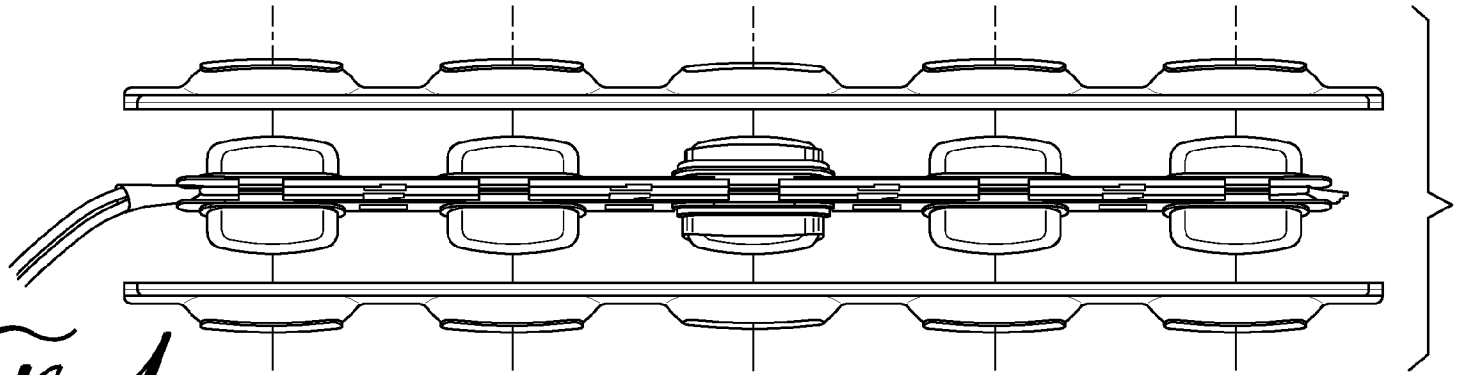
FIG. 4 is an exploded view of a heating structure of the apparatus of FIG. 1.

Optionally and preferably, a local thermal insulator 33 is placed in each opening to surround each heating element 23. The local thermal insulator 33 can be any shape, such as a ring, so long as the insulator 33 surrounds the heating element 23. The insulator 33 is not attached to, nor is it part of the heating element 23. The middle two heating elements 23 in FIG. 4 show one way that an insulator 33 can surround the heating element 23.

The local thermal insulator 33 can be made out of any thermally insulating materials. Examples of thermally insulating materials are, for example, silicone, ceramic, high temperature plastics, and natural rubber. The insulator 33 aids in insulating the heating structure 13 from heat from the heating element 23.

The case 14, referred to above, can be opened to allow access to the apparatus 10. The case 14 can be closed to allow for transportation and storage. The heating structure 13 is not accessible when the case 14 is closed. The case 14 can be made out of a soft material such as nylon, polyurethane weave, and polyester. Optionally, the case 14 can contain pockets.

Additionally, the apparatus 10 can contain a power indicator 34 and an on/off switch 35 (Shenzhen Creation Electronics, Shenzhen, PRC).

The heated hair clips 11 can be used to style hair when hair is placed inside the heatable member 17. For example, use of the hair clips 11 can make a user's hair curly or wavy. It is contemplated that either dry or slightly wet hair can be styled by the apparatus 10.

In use, the hair clip 11 is positioned on top of the heating element 23 with the heatable member 17 in contact with the heating element 23. Since the jaws 15*a*, 15*b* of each hair clip 11 are biased to a closed position, the hair clip 11 is retained on a heating element 23 while the heatable member 17 is heated. The user then merely grips the finger grip 16 portion of the hair clip 11, squeezes the sides together, and removes the hair clip 11 from the heating element 23. The hair clip 11 is then positioned over the hair which has been formed into a curl, with the hair located inside the heatable member 17.

When electrical power is supplied to the apparatus 10, the heating element 23 is heated while the thermal insulators 30*a*, 30*b* remain unheated. This is an improvement over prior inventions in which the heating structure 13 was entirely heated. In addition, the apparatus 10 is able to retain more heat since heat is not lost through the insulated thermal insulators 30. This retention of heat is energy efficient. Providing an electrical heater 22 with portions that are insulated is also safer for the consumer, as there is less area on the electrical heater 22 that would be likely to burn a consumer.

EXAMPLE

The hair clips 11 were secured to the heating elements 23 on the heating structure 13 with the heatable member 17 on the outside surface 27 of the heating element 23. The apparatus 10 was turned on, and the heating elements 23 were heated, which in turn heated the heatable members 17 of the hair clips 11. Optionally, the unit can be turned on after some or all of the clips are in place.

The user's hair was prepared for insertion into the hair clip 11. Preparation included wrapping sections of the hair around the user's fingers or a comb in order to produce a circular curl. A circular figure eight pattern of hair was also used to form the user's hair before it was inserted into the hair clips 11. Smaller sections of hair placed inside the hair clip 11 produced tighter curls, while larger sections of hair gave looser curls.

After heating, the heated hair clip 11 was removed from the heating element 23 and placed on the curl. The heated hair clip 11 was left on the hair and allowed to cool. The longer heat clip was cooled, the longer the hair held a curl.

When the hair clip 11 was cool, the jaws 15*a*, 15*b* of the hair clip 11 were opened and the hair clip 11 was removed from the hair. The hair was then further styled by the user's fingertips, or by a brush.

Among the advantages of an apparatus according to the present invention is safety for the user in that the region between heating elements remains cool, and increased energy efficiency in that only the heating elements are heated.

Although the present invention has been described in considerable detail with reference to certain preferred embodiments, other embodiments are possible. For example, the temperature of the apparatus can be regulated by the user. The steps disclosed for the present methods, for example, are not intended to be limiting nor are they intended to indicate that each step is necessarily essential to the method, but instead are exemplary steps only. Therefore, the scope of the appended claims should not be limited to the description of preferred embodiments contained in this disclosure. All references cited herein are incorporated by reference in their entirety.

What is claimed is:

1. Apparatus for heating hair clips having a heatable member, the apparatus comprising:

a. a tray having a longitudinal axis;

b. at least two heating structures, each heating structure comprising:

i. an elongated heating bar having opposed side surfaces and extending longitudinally in the base; and ii. a plurality of thermally conductive heat conductors in thermally conductive relationship with the heating bar for heating the heatable members of the hair clips, wherein there are heat conductors on each of the opposed side surfaces of the heating bar, the heat conductors being formed of a thermally conductive material and separated from each other by a thermal insulator made of a thermally insulating material; and c. means for providing electricity for powering the heating bars.

2. The apparatus of claim 1, wherein there are at least two heating structures, each heating bar has side surfaces, and wherein the heat conductors are disposed in pairs on the side surfaces of each heating bar for heating two heatable members of the hair clip simultaneously.

3. The apparatus of claim 1 comprising a silicone ring around each heat conductors.

4. The apparatus of claim 3 wherein the silicone ring is generally oval shaped.

5. The apparatus of claim 1, wherein the at least two heating structures are substantially parallel to each other.

6. The apparatus of claim 1, wherein the tray has opposed end walls and each heating structure extends from one end wall to the other end wall.

7. The apparatus of claim 1, comprising in addition a soft openable case for the tray, the case having an open configuration wherein each heating structure is accessible and a closed configuration wherein each heating structure is not accessible.

8. The apparatus of claim 1, wherein the heat conductors have one or more convex surfaces.

9. The apparatus of claim 1, comprising a temperature controller for use in controlling the temperature of the heating bar.

10. The apparatus of claim 1, wherein the heating structure comprises at least one heat balancer positioned proximate to the heating bar for distributing heat from the heating bar to the heat conductors.

11. The apparatus of claim 1, wherein the heating structure comprises a bracket with openings for holding the heat conductors in place.

12. A method of styling hair using the apparatus of claim 1 comprising the steps of:

a. electrically heating the heat conductors;

b. before or after or during step (a), positioning hair clips having a heatable member on the heat conductors and allowing the heatable member on the hair clip to heat;

c. placing at least some of the heated hair clips on the hair; and d. removing the placed hair clips from the hair after they cool, thereby styling hair.

13. Apparatus for heating hair clips having a heatable member, the apparatus comprising:

a. a base;

b. a heating structure comprising:

i. an elongated electrical heater having opposed sides;

ii. a plurality of pairs of thermally conductive heat conductors on each of the opposed sides of the electrical heater for heating the heatable members of the hair clips, the heat conductors being formed of a thermally conductive material;

iii. a bracket on each side of the electrical heater for supporting the heat conductors in thermally conductive contact with the electrical heater; and iv. a thermal insulator between heat conductors separating the heat conductors from each other, the thermal insulator made of a thermally insulating material which do not conduct substantial quantities of thermal energy when the heat conductors are heated; and c. means for providing electricity to the electrical heater.

14. The apparatus of claim 13 wherein the heat conductors comprises at least one heat balancer positioned adjacent to the electrical heater for distributing heat from the heater to the heat conductors.

15. The apparatus of claim 13, wherein there are at least two heating structures, and wherein the heat conductors are disposed in pairs on the side surfaces of each heating structure for heating two heatable members of the hair clip simultaneously.

16. The apparatus of claim 15 wherein the at least two heating structures are substantially parallel to each other.

17. The apparatus of claim 13 comprising a silicone ring around each heat conductors.

18. The apparatus of claim 17 wherein the silicone ring is generally oval shaped.

19. The apparatus of claim 13, wherein the base has opposed end walls and each heating structure extends from one end wall to the other end wall.

20. The apparatus of claim 13, comprising in addition a soft openable case for the base, the case having an open configuration wherein each heating structure is accessible and a closed configuration wherein each heating structure is not accessible.

21. The apparatus of claim 13, wherein the heat conductors have one or more convex surfaces.

22. The apparatus of claim 13, comprising a temperature controller for use in controlling the temperature of the heater.

* * * * *

UNITED STATES PATENT AND TRADEMARK OFFICE

CERTIFICATE OF CORRECTION

PATENT NO. : 7,989,735 B1
APPLICATION NO. : 12/950978
DATED : August 2, 2011
INVENTOR(S) : Richmond et al.

It is certified that error appears in the above-identified patent and that said Letters Patent is hereby corrected as shown below:

Title page, illustrative fig. 1 should be deleted and substitute therefore the attached title page consisting illustrative fig. 1.

In the Drawings

In the drawings, Fig(s) 1-7 should be deleted and substitute therefore the attached figures 1-7 as shown on the attached sheets.

Signed and Sealed this
Third Day of April, 2012

David J. Kappos

David J. Kappos
*Director of the United States Patent and Trademark Office*

(12) United States Patent
Richmond et al.

(10) Patent No.: US 7,989,735 B1
(45) Date of Patent: Aug. 2, 2011

(54) HEATING APPARATUS FOR HEAT RETAINING HAIR CLIPS

(75) Inventors: David Richmond, Culver City, CA (US); Howard Richmond, Culver City, CA (US); Henry K. Yu, El Segundo, CA (US); Matthew W. Tivnon, El Segundo, CA (US); Craig R. Steele, El Segundo, CA (US)

(73) Assignee: Linda Flowers, Los Angeles, CA (US)

( * ) Notice: Subject to any disclaimer, the term of this patent is extended or adjusted under 35 U.S.C. 154(b) by 0 days.

(21) Appl. No.: 12/950,978

(22) Filed: Nov. 19, 2010

(51) Int. Cl.

| | |
|---|---|
| ***H05B 3/22*** | (2006.01) |
| ***H05B 3/26*** | (2006.01) |
| ***A45D 2/36*** | (2006.01) |
| ***A45D 4/16*** | (2006.01) |
| ***A45D 4/18*** | (2006.01) |

(52) U.S. Cl. ..... 219/222; 219/225; 219/521; 219/530; 219/537; 219/540; 132/231; 132/234; 132/277

(58) Field of Classification Search ..... None
See application file for complete search history.

(56) References Cited

U.S. PATENT DOCUMENTS

| | | | | | |
|---|---|---|---|---|---|
| 2,127,784 | A | * | 8/1938 | Rosch | 132/234 |
| 2,133,573 | A | * | 10/1938 | Rifle | 126/229 |
| 2,143,740 | A | * | 1/1939 | McIntosh | 132/211 |
| 2,161,202 | A | * | 6/1939 | Schleimer | 219/242 |
| 2,491,939 | A | | 12/1949 | Tasho | |
| 3,045,097 | A | * | 7/1962 | Sellers | 219/539 |
| 3,858,029 | A | * | 12/1974 | Walter | 219/222 |
| 3,887,790 | A | * | 6/1975 | Ferguson | 219/535 |
| 3,889,097 | A | * | 6/1975 | Forsberg | 219/242 |
| 4,661,683 | A | * | 4/1987 | Glucksman | 219/222 |
| 4,766,291 | A | * | 8/1988 | Collins | 219/534 |
| 5,294,777 | A | | 3/1994 | Denhup | |
| 5,522,407 | A | | 6/1996 | Kelsey | |
| D388,903 | S | * | 1/1998 | Kelsey | D28/38 |
| 5,873,377 | A | | 2/1999 | Yang | |
| 6,248,979 | B1 | * | 6/2001 | Cafaro | 219/222 |
| 7,631,649 | B2 | | 12/2009 | Coral et al. | |
| 2005/0087205 | A1 | | 4/2005 | Rizzuto | |
| 2008/0236606 | A1 | | 10/2008 | Flowers | |

* cited by examiner

*Primary Examiner* — Joseph M Pelham

(74) *Attorney, Agent, or Firm* — Laura M. Lloyd; Jeffrey G. Sheldon; Sheldon Mak & Anderson

(57) ABSTRACT

Apparatus for heating hair clips having a heatable member comprises a base, a heating structure, and means for providing electricity to the heating structure. The heating structure can comprise an elongated electrical heater having opposed sides, a plurality of thermally conductive heating elements in pairs on each side of the electrical heater, and a thermal insulator between the heating elements separating the heating elements from each other.

22 Claims, 5 Drawing Sheets

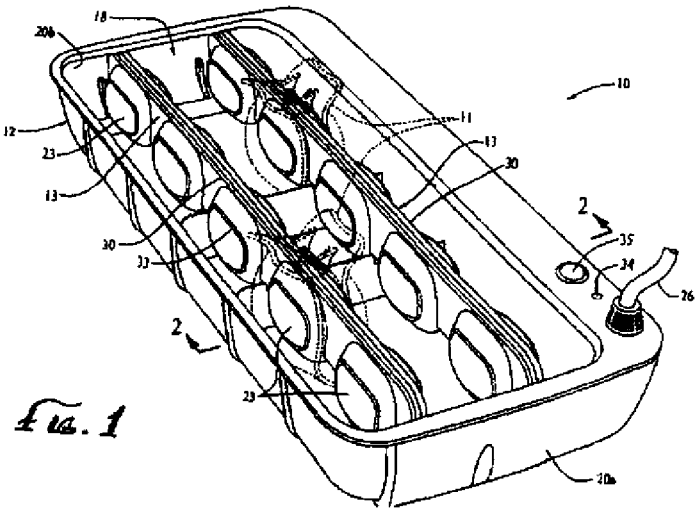

Fig. 1

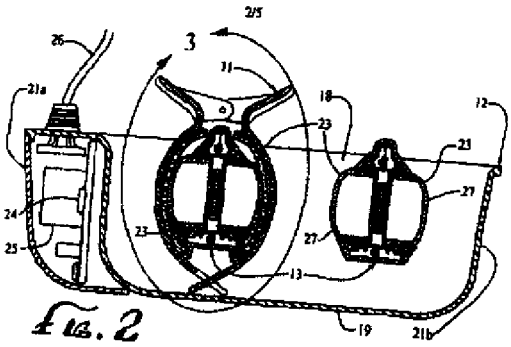

Fig. 2